US006104821A

United States Patent [19]

Husung

[11] Patent Number: 6,104,821

[45] **Date of Patent: *Aug. 15, 2000**

[54] ELECTRICAL HEARING AID DEVICE WITH HIGH FREQUENCY ELECTROMAGNETIC RADIATION PROTECTION

[75] Inventor: Kunibert Husung, Erlangen, Germany

[73] Assignee: Siemens Audiologische Technik GmbH, Erlangen, Germany

[ * ] Notice: This patent is subject to a terminal disclaimer.

[21] Appl. No.: 08/919,210

[22] Filed: Aug. 28, 1997

[30] Foreign Application Priority Data

Oct. 2, 1996 [EP] European Pat. Off. ..... 96115851

[51] Int. Cl.[7] ..... H04R 25/00

[52] U.S. Cl. ..... 381/312; 381/321

[58] Field of Search ..... 381/312, 320, 381/321, 322, 324

[56] References Cited

U.S. PATENT DOCUMENTS

| | | |
|---|---|---|
| 4,259,637 | 3/1981 | Scott . |
| 4,918,591 | 4/1990 | Link . |
| 4,993,072 | 2/1991 | Murphy . |
| 5,182,531 | 1/1993 | Fiedler et al. . |
| 5,640,457 | 6/1997 | Gnecco et al. . |
| 5,708,720 | 1/1998 | Meyer . |
| 5,796,848 | 8/1998 | Martin . |
| 5,809,151 | 9/1998 | Husung . |

FOREIGN PATENT DOCUMENTS

| | | |
|---|---|---|
| 401 595B | 10/1996 | Austria . |
| 4343702 | 12/1993 | Germany . |
| 4242097 | 6/1994 | Germany . |
| 4343703 | 1/1995 | Germany . |
| WO 96/37086 | 5/1996 | WIPO . |
| 29608215 | 8/1996 | WIPO . |

*Primary Examiner*—Curtis A. Kuntz
*Assistant Examiner*—P. Dabney
*Attorney, Agent, or Firm*—Hill & Simpson

[57] ABSTRACT

An electrical hearing aid device has a housing in which an integrated amplifier circuit is located. Also contained in the housing is at least one microphone, a switch, a filter, amplifier and a voltage source. The amplifier circuit also has at least one earphone allocated to the amplifier circuit. A protective device provides protection against high frequency electrical waves wherein the integrated amplifier circuit is protected against access of line bound radio frequency currents by filter elements. The filter elements are provided in electrical terminals of the amplifier circuit and directly at the integrated circuit.

8 Claims, 2 Drawing Sheets

ELECTRICAL HEARING AID DEVICE WITH HIGH FREQUENCY ELECTROMAGNETIC RADIATION PROTECTION

BACKGROUND OF THE INVENTION

The present invention generally relates to an electrical hearing aid device with a housing in which an integrated amplifier circuit is arranged having at least a microphone, switch and/or connection means, filter means, amplifier means and a voltage source. The amplifier circuit also has at least one earphone allocated to it. A protective device is provided and is fashioned against high-frequency electrical waves.

Parasitic electromagnetic radiation is demodulated in active components of an electronic hearing aid circuit. The low-frequency noise signal can then lead to the outage or, respectively, to a reduction in the functionability of an electrical hearing aid device.

For electromagnetic shielding of a hearing aid from radio signals of outside transmission devices, such as, for example, mobile radiotelephone devices, car telephones, microwave irradiation devices of other RF transmitters, German Patent No. DE-C-43 43 702 provides a shielding of the hearing aid housing such that the hearing aid housing is formed of at least two electrically conductive parts that can be electrically conductively connected via a high-frequency seal. Since the hearing aid housing also has openings for the admission and output of sound as well as clearances for switch means, potentiometers, controls, programming plugs or the like and a battery compartment to be opened or an accessible battery compartment, an electromagnetic housing shielding has various problem locations.

German Patent No. DE-C-43 43 703 discloses a hearing aid worn at the head that has a housing in which an amplifier circuit is arranged that has at least a microphone, an earphone and a battery wherein at least one protective device fashioned as an electrically conductive amplifier circuit from high-frequency electrical waves is provided such that the protective means for high-frequency has a conductive connection to an electrical terminal of the amplifier circuit and further wherein electrical means that form an electrical resistance for the high-frequency are provided in the conductive connection.

Modern hearing aid circuits are distinguished by LSI active circuits having only minimal outside wiring. All non-linear components are, therefore, usually located within the integrated circuit. Line-bound high-frequency noise currents can thus be demodulated only in the integrated circuit and, thus, lead to a degradation or, respectively, to the functional outage of the hearing aid.

SUMMARY OF THE INVENTION

In an electrical hearing aid device of the type discussed, the present invention improves the protective device against high-frequency electromagnetic radiation.

This is achieved by the present invention using an integrated amplifier circuit protected against the access of line-bound RF currents by filter elements wherein the filter elements are provided in electrical terminals of the amplifier circuit and directly at the integrated circuit (IC).

So that the function of an integrated hearing aid circuit is not degraded by line-bound RF currents—caused by high-frequency electromagnetic radiation that, for example, is generated during the use of mobile radiotelephone devices—the protective device of the hearing aid device of the present invention is fashioned such that these disturbing RF currents are shielded from or, respectively, diverted from the integrated circuit. It is thereby important that the filter means provided therefor in the electrical leads of the integrated hearing aid circuit are arranged directly at the integrated circuit (IC).

The filter elements can be of the first or second order or of a higher order.

In an embodiment of the present invention, an electrical hearing aid device is provided having a housing in which an integrated amplifier circuit is arranged having at least one microphone, switch and/or connection means, filter means, amplifier means and a voltage source wherein the amplifier circuit also has at least one earphone allocated to the amplifier circuit. The device further provides a protective device fashioned against high-frequency electrical waves wherein the integrated amplifier circuit is protected against the access of line-bound RF currents by filter elements wherein the filter elements are provided in electrical terminals of the amplifier circuit and directly at the integrated circuit.

In an embodiment, RF filter means implemented as passive filters of the first order are provided as the filter elements.

In an embodiment, RF filter means implemented as passive filters of the second order and/or of a higher order are provided as the filter elements.

In an embodiment, the filter elements are arranged in the electrical terminals of the microphone to the amplifier means and in the electrical terminals of the integrated amplifier circuit to the earphone, to the battery and to a volume control.

In an embodiment, a RF filter element arranged in the electrical terminal of the hearing aid IC to an audio input.

In an embodiment, a filter substrate has capacitors with RF quality for all electrical terminals of the hearing aid IC for shielding the hearing aid IC from line-bound RF currents.

In an embodiment, the capacitors to a reference potential are arranged in a star-point-like manner in the filter substrate.

In another embodiment of the present invention, the hearing aid IC is arranged on a filter substrate board having filter elements against line-bound RF currents wherein the electrical terminals of the hearing aid IC are directly electrically connected to the filter substrate board.

Since a complex hearing aid IC has an extremely great number of external terminals, a suitable protective means should be fashioned such that it covers all terminals. Due to the involved filtering and the additional condition of having to pay attention to short line connections, it is proposed that, in a simple embodiment, a filter substrate of, for example, the first order is provided that has capacitors with RF quality for all IC terminals that are preferably connected to a reference potential in a star-point-like manner. Such a filter substrate plate with low structural height can be placed directly under the hearing aid IC and can be directly electrically connected thereto.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
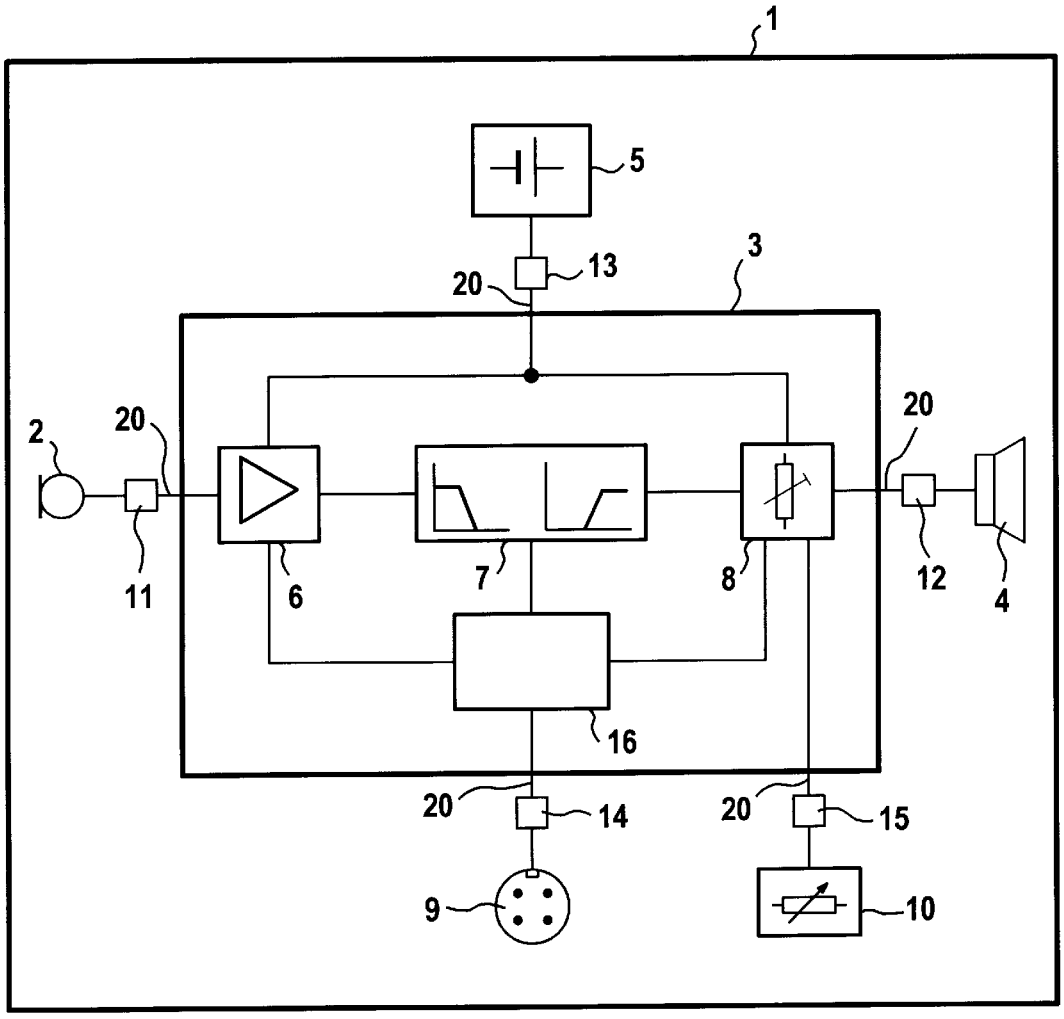
FIG. 1 illustrates a block circuit diagram of an embodiment of a hearing aid device of the present invention.

The hearing aid device of the present invention can be a pocket hearing aid or a hearing aid to be worn on the body or a hearing aid device to be worn at the head, whereby the latter can be a hearing aid to be worn behind the ear (BTE) or a hearing aid to be worn in the ear (ITE). Such electrical hearing aid devices have a housing 1 in which a microphone 2 or, dependent on the embodiment, two microphones or a microphone and an induction coil or telephone coil (not shown) is or, respectively, are accommodated. Given the hearing aid device of FIG. 1, an earphone 4 is also arranged in the hearing aid housing 1 wherein an integrated amplifier and transmission circuit 3 to which, for example, a preamplifier 6, a signal filter block 7 and a switch means for setting the gain with a volume control 10 are allocated is located in the signal path between the sound transducers 2, 4. A voltage source 5, for example a battery or an accumulator, that is also provided in the housing 1 serves as the energy supply for the sound transducers 2, 4 and of the active, other components of the circuit 3. The integrated amplifier and transmission circuit (IC) of the hearing aid may also have a control and data processing unit 16. The hearing aid device according to the illustrated exemplary embodiment may also be provided with an audio input 9 and/or a programming jack.

For protecting the integrated circuit against line-bound RF currents, filter elements 11–15 that protect the integrated circuit against RF currents and divert these disturbing RF currents to, for example, a shared reference potential are provided directly at the IC, in the electrical terminals thereof to, for example, the microphone 2, the earphone 4, the battery 5, the audio input 9 and the volume control 10; for example, a metallic housing 1 or such a housing section of the hearing aid device can be employed for the ground forming a potential. On the other hand, a carrier of the amplifier circuit 3 may have an additional ground layer in a printed circuit board of the amplifier circuit for such a virtual ground.

Figure 2:
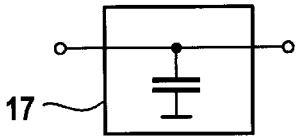
FIG. 2 illustrates an embodiment of a RF filter element as a passive filter of the first order.
Figure 3:
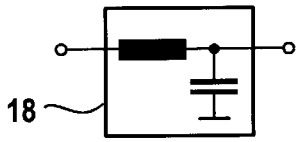
FIG. 3 illustrates an embodiment of a RF filter element as a passive filter of the second order.

Referring to FIGS. 2 and 3, exemplary embodiments of the fashioning of the employable RF filter elements are shown. In accord therewith, such a RF filter element can be designed as a passive filter 17 of the first order or as a passive filter 18 of the second order or of a higher order.

Figure 4:
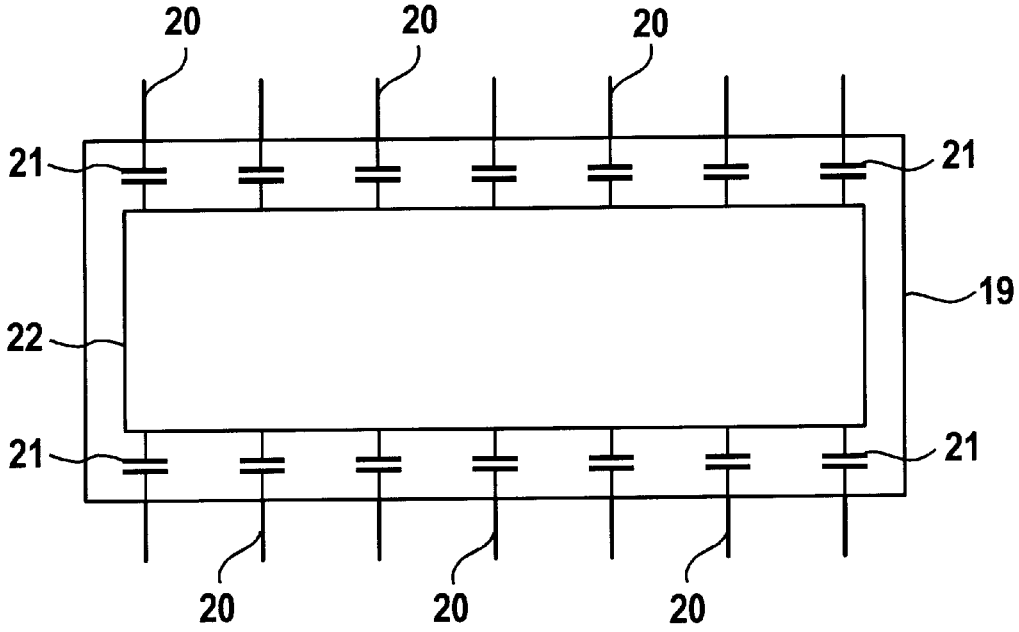
FIG. 4 illustrates a hearing aid IC with its electrical terminals and a protective means composed of a filter substrate with capacitors having RF quality in an embodiment of the present invention.

An especially advantageous embodiment of the invention is shown in FIG. 4. In order, given a complex hearing aid IC 19 that has a comparatively great number of electrical terminals 20 to fashion the protective means against line-bound radio frequency noise currents simply and with little expense, it is provided by the present invention that the filter elements, that is capacitors 21 with RF quality here, are embedded in a filter substrate 22. It is thereby possible to fashion the line connections short wherein the capacitors are preferably connected to a reference potential in a star-point-like manner. For example, a ground layer (not shown) of a printed circuit board or an electrically conductive housing section of the hearing aid housing 1 may form such a reference potential.

Figure 5:
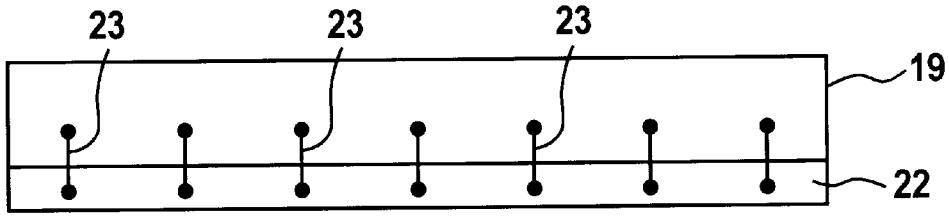
FIG. 5 illustrates an integrated hearing aid circuit arranged in electrical connection on a filter substrate plate.

According to the exemplary embodiment shown in FIG. 5, the hearing aid IC 19 is arranged on a filter substrate board 22 that has filter elements against line-bound RF currents wherein the electrical terminals of the hearing aid IC 19 are directly electrically connected to the filter substrate board 22. These electrical connections between the filter substrate board 22 and the electrical terminals of the hearing aid IC 19 are referenced at 23 in FIG. 5.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. An electrical hearing aid device comprising:

a housing in which an integrated amplifier circuit is arranged having at least one microphone, switch and/or connection means, filter means, amplifier means and a voltage source wherein the amplifier circuit also has at least one earphone allocated to the amplifier circuit; and a protective device fashioned against high-frequency electrical waves wherein the integrated amplifier circuit is protected against the access of line-bound RF currents by filter elements wherein the filter elements are provided in electrical terminals of the amplifier circuit and directly at the integrated circuit.

2. The hearing aid device according to claim 1 further comprising:

RF filter means implemented as passive filters of the first order are provided as the filter elements.

3. The hearing aid device according to claim 1 further comprising:

RF filter means implemented as passive filters of the second order and/or of a higher order are provided as the filter elements.

4. The hearing aid device according to claim 1 wherein the filter elements are arranged in the electrical terminals of the microphone to the amplifier means and in the electrical terminals of the integrated amplifier circuit to the earphone, to the battery and to a volume control.

5. The hearing aid device according to claim 1 further comprising:

a RF filter element arranged in the electrical terminal of the hearing aid IC to an audio input and/or to a programming jack.

6. The hearing aid device according to claim 1 further comprising:

a filter substrate having capacitors with RF quality for all electrical terminals of the hearing aid IC for shielding the hearing aid IC from line-bound RF currents.

7. The hearing aid device according to claim 6 wherein the capacitors to a reference potential are arranged in a star-point-like manner in the filter substrate.

8. The hearing aid device according to claim 1 wherein the hearing aid IC is arranged on a filter substrate board having filter elements against line-bound RF currents wherein the electrical terminals of the hearing aid IC are directly electrically connected to the filter substrate board.

* * * * *